US006500328B1

(12) United States Patent
Fortunati et al.

(10) Patent No.: US 6,500,328 B1
(45) Date of Patent: Dec. 31, 2002

(54) METHOD FOR PICKLING STEEL PRODUCTS

(75) Inventors: Sandro Fortunati, Terni (IT); Franco Mancia, Rome (IT); Augusto Musso, Rome (IT)

(73) Assignee: Acciai Speciali Terni S.p.A., Temi (IT)

( * ) Notice: Subject to any disclaimer, the term of this patent is extended or adjusted under 35 U.S.C. 154(b) by 0 days.

(21) Appl. No.: 09/555,091

(22) Filed: Jul. 19, 2000

Related U.S. Application Data

(63) Continuation of application No. PCT/IT98/00337, filed on Nov. 24, 1998.

(30) Foreign Application Priority Data

Nov. 24, 1997 (IT) ..... RM97A0727

(51) Int. Cl.[7] ..... C23G 1/08
(52) U.S. Cl. ..... 205/704; 205/771; 134/41
(58) Field of Search ..... 205/704, 771; 134/41

(56) References Cited

U.S. PATENT DOCUMENTS 5,851,304 A * 12/1998 Giraud et al. ..... 134/3

FOREIGN PATENT DOCUMENTS

| | | |
|---|---|---|
| DE | 37 19 604 | 12/1988 |
| DE | 39 37 438 | 8/1990 |
| EP | 0 501 867 | 9/1993 |
| EP | 0 769 575 | 4/1997 |
| EP | 0792 949 | 9/1997 |
| GB | 869218 | 5/1961 |
| JP | 63216986 | * 9/1988 |
| WO | WO 97/43463 | * 11/1997 |
| WO | 97 43463 | 11/1997 |
| WO | 98 26111 | 6/1998 |
| WO | 98 38353 | 9/1998 |

OTHER PUBLICATIONS

Patent Abstracts of Japan, Publication No. 02205692, Publication Date Aug. 15, 1990.
Patent Abstracts of Japan, Publication No. 63216986, Publication Date Sep. 9, 1988.
Patent Abstracts of Japan, Publication No. 01165783, Publication Date Jun. 29, 1989.
XP 002016316 Chemical Abstracts, vol. 84, No. 24 (1976).
XP 002066477 Chemical Abstracts vol. 84, No. 20, (1976).
Patent Abstracts of Japan Publication No. 10162485, Publication Date Mar. 8, 1989.

* cited by examiner

*Primary Examiner*—Arun S. Phasge
(74) *Attorney, Agent, or Firm*—Browdy and Neimark, PLLC

(57) ABSTRACT

Method for pickling products made of steel, characterized in that within the pickling bath $Fe^{3+}$ is present, directly added in a controlled concentration, or produced in the pickling bath itself by adding an oxidizing agent such as hydrogen peroxide, ozone, permanganates. persulphates and oxygen.

19 Claims, 1 Drawing Sheet

A: Pickling bath

B: Circulating pump

CA: Anodic Compartment

CC: Cathodic Compartment

A: Pickling bath

B: Circulating pump

CA: Anodic Compartment

CC: Cathodic Compartment

METHOD FOR PICKLING STEEL PRODUCTS

CROSS REFERENCE TO RELATED APPLICATION

Figure 1:
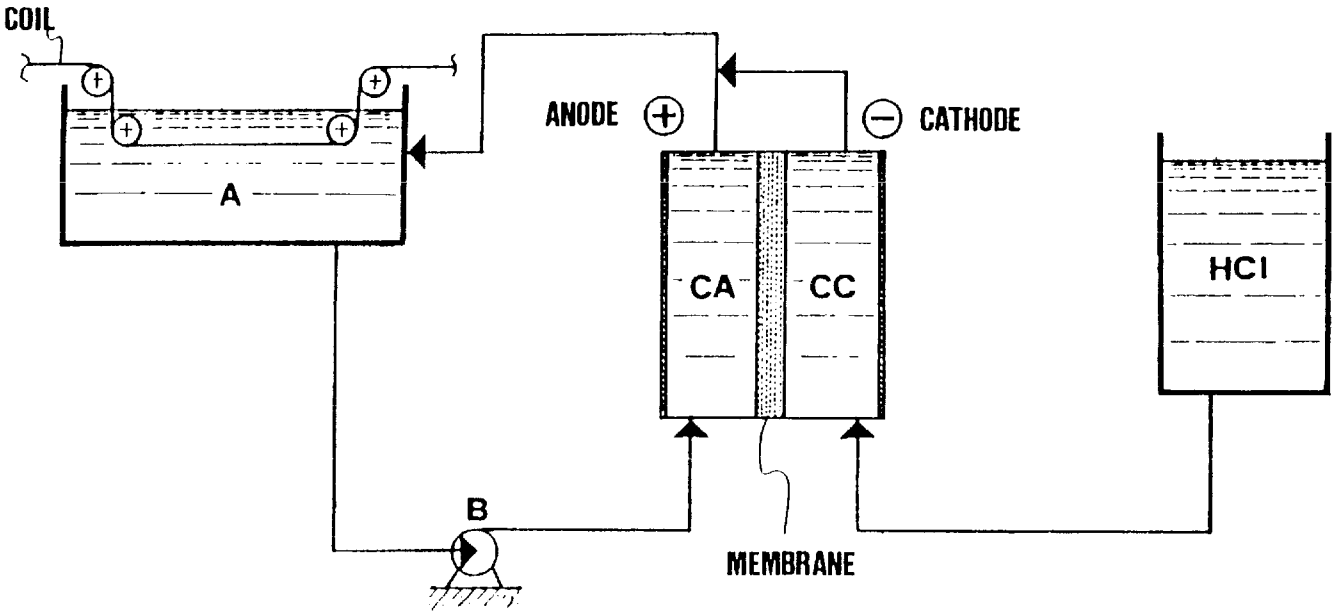

The present application is the national-stage under 35 U.S.C. 371 of PCT/IT98/00338, filed Nov. 24, 1998.

The present invention relates to a method for pickling steels and, more specifically , carbon steels, magnetic steels (containing Si) and stainless steels with a chrome content lesser or equal to 15% (i.e. AISI 409), wherein the $Fe^{3+}$ ion is used as an additive in the bath to increase the reaction kinetics.

In order to realise an efficient pickling process of the carbon steels, class whereto also magnetic steels containing Si belong, hydrochloric (HCl) or sulphuric ($H_2SO_4$) acid is normally used, or mixtures thereof, at a temperature that generally varies between 60 and 75° C. For stainless steels with a low chrome level, e.g. AISI 409 of the ferric class, analogous baths can be adopted as well.

The main reaction of pickling, to allow the removal of the scale of thermal oxide, is the dissolution (through oxidation) of the iron base according to the anodic half-reaction:

$$Fe \rightarrow Fe^{2+} + 2e. \quad (1)$$

The corresponding cathodic half-reaction in acid environment is the ion H+reduction that develops hydrogen:

$$2H^{+} + 2e \rightarrow H_2 \quad (2)$$

Therefore, the resulting total reaction is:

$$Fe + 2H^{+} \rightarrow Fe^{2+} + H_2 \quad (3)$$

As is known from the study of electro-chemical reactions, the kinetics thereof is strongly influenced by the values of the electrode potential.

An additive of oxidising species is added to the pickling bath, enabling to obtain a more noble electrode potential of the steel to be pickled, thereby allowing higher reaction kinetics.

The species preferred as oxidant is the $Fe^{3+}$ ion.

The possibility of obtaining a more noble potential of the steel to be pickled derives from the fact that the added ferric ions $Fe^{3+}$ behave as oxidant (being reduced to $Fe^{2+}$ ions) with respect of the steel (Fe) that is to be pickled according to reaction (1) (that derives from the reversible electro-chemical potential scale: $E_{rev}$=−447 mV SHE for the $Fe^{2+}$/Fe couple; $E_{rev}$=+771 mV SHE for the $Fe^{3+}$/ $Fe^{2+}$ couple).

Therefore, the $Fe^{3+}$ ion is capable of being reduced to $Fe^{2+}$ ion during the pickling process, according to the cathodic half-reaction below:

$$Fe^{3+} \rightarrow Fe^{2+} + e \quad (4)$$

Also the cathodic half-reaction (4) occurs at the same time of the anodic half-reaction (1). The resulting reaction (1)+(4) therefore is:

$$Fe + 2Fe^{3+} \rightarrow 3Fe^{2+} \quad (5)$$

When the $Fe^{3+}$ ion is present as an additive the reactions (3) and (5) occur at the same time, with an increase of the global iron (Fe) dissolution kinetics.

The working electrode potential Ew results, in this case by effect of the addition of the oxidising species ($Fe^{3+}$) in the bath, more noble than the potential in absence of additions.

The amount of $Fe^{3+}$ ion that has to be added must balance the amount of $Fe^{3+}$ ion consumed in the cathodic reaction (4).

A good stirring of the bath further improves the pickling kinetics, allowing the depolarisation of the total cathodic reaction resulting from the sum of the reactions (2) and (4) that would tend, without stirring, towards diffusion control conditions.

In EP 0792949A1 a pickling process for steel products is disclosed in which the concentration of $Fe^{+3}$ ions is comprised in the range 1–300 g/l by oxidation of the $Fe^{+2}$ ions obtained during the pickling.

According to the present invention, the $Fe^{3+}$ ion can after all be added directly, e.g. as ferric chloride or ferric sulphate. However, it can be obtained in the bath by the addition of other oxidants, particularly $H_2O_2$ (hydrogen peroxide), ozone or permanganates. In fact, once added to the pickling bath those oxidants come to contact with a solution already rich in $Fe^{2+}$ (due to the primary pickling reaction (1) the bath is always rich in $Fe^{2+}$ ions) and induce the oxidation of $Fe^{2+}$ to $Fe^{3+}$. Even oxygen alone, added in conditions of stirring by air bubbling, or admixed in an external reactor with the pickling solution, works as an oxidising agent capable of producing $Fe^{3+}$.

A preferred embodiment of the method described here according to the invention is that of obtaining $Fe^{3+}$electro-chemically, sending the pickling solution as anolyte in an electrolytic cell, and carrying out an anodic oxidation of the $Fe^{2+}$ ion that, as aforestated, is always present in the bath, according to the reaction:

$$Fe^{2+} \rightarrow Fe^{3+} + e. \quad (6)$$

Therefore, it is an object of the present invention to provide a method for pickling steel products, wherein in the pickling bath $Fe^{3+}$ is present in a concentration comprised in the range 6–60 g/l, directly added or produced in the pickling bath itself by the addition of an oxidising agent selected from the group comprising: hydrogen peroxide, ozone, permanganates, persulphates, and oxygen.

Advantageously, the obtained increase of the pickling kinetics is a function of the added $Fe^{3+}$ concentration that is maintained in the pickling bath itself, thereby improving also the productivity of the industrial lines.

A further advantage, according to the invention, lies in the fact that the maintenance and/or the control of the $Fe^{3+}$ ions concentration in the pickling bath allows a strict control of the most critical parameter of the process (that is the potential redox value of the system) with further advantages on the final quality of the product as well.

According to the present invention, continuous pickling lines of carbon and/or magnetic steels can be employed advantageously also for the pickling of stainless steels with a <15% Cr content. This result was made possible by the fact that, according to the present invention, the $Fe^{3+}/Fe^{2+}$ ratio is employed as a control parameter of the reaction kinetics, jointly with the acid concentration control. In fact, when it is desired to use the same carbon and magnetic steels production line for the stainless steels, e.g. of the AISI 409 type, the presence and the maintenance of appropriate $Fe^{3+}$ concentration values allows in any case to widely control the pickling kinetics, for the carbon steels as well as for the stainless ones, thereby making possible the combined utilisation of these production lines.

Advantageously, the method according to the invention proves to be compatible with the possible presence of corrosion inhibitors, normally employed to avoid drawbacks of carbon steels over-pickling.

Furthermore, always according to the present invention, it is possible to pickle these abovementioned steel types without resorting to mechanical processes of descaling such for instance as peening.

A further object of the present invention is to provide different embodiments, as hereinafter specified, of the method for the direct production of the oxidant $Fe^{3+}$ within the pickling bath:

(i) direct addition of $Fe^{3+}$ as reactant (for instance: ferric chloride or sulphate);

(ii) addition of oxidants for the production $Fe^{3+}$ by oxidation of the $Fe^{2+}$ ion present in the bath to $Fe^{3+}$;

(iii) oxidation of the $Fe^{2+}$ ion in an electrolytic cell present in the bath itself to $Fe^{3+}$.

According to the third embodiment, the same pickling solution itself (composed of aqueous solution of hydrochloric acid and/or sulphuric and, optionally of phosphoric acid) constitutes the cell anolyte, the oxidising agent to be added as additive being the ferric ion produced at the anode by oxidation of the ferrous ion present within the bath.

The catholyte is preferably composed of an aqueous solution of hydrochloric and/or sulphuric acid. Also the catholyte is preferably sent out continuously into the pickling solution, to reintegrate the HCl or the $H_2SO_4$ that is consumed during the pickling reaction.

According to the method of the invention, an electrochemical cell of the membrane type is preferably employed as shown in FIG. 1.

The use of a cell to generate the oxidising species $Fe^{3+}$, according to the third embodiment, is more advantageous in respect of a method wherein oxidants are directly added. A remarkable saving in operation cost is obtained, on account of the higher cost of the oxidising reactants themselves.

Furthermore, some reactants entail stability problems within the bath, or may cause, if not opportunely measured, the development of chlorine from the hydrochloric acid bath.

The pickling bath according to the present invention has a temperature preferably comprised in the range 45–85° C.

The pickling solution is an aqueous solution of hydrochloric and/or sulphuric acid and optionally of phosphoric acid, with the composition hereinafter expressed as percent by weight:

free HCl from 0 to 250 g/l (>100 g/l if alone);

free $H_2SO_4$ from 0 to 250 g/l (>100 g/l if alone);

free $H_3PO_4$ from 0 to 100 g/l;

$Fe_{tot}=(Fe^{2+}+Fe^{3+})>50$ g/l;

$Fe^{3+}$ (additive) from 5 to 60 g/l;

Furthermore, products containing iron (steels) whereto the method of the present invention can be applied are selected from the group comprising:

carbon steels, rolled or anyhow hot or cold worked, Particularly low carbon steels and carbon steels with a low, medium or high content of alloying elements;

magnetic steels (containing Si or Si and Al);

stainless steels with a low (<15%) Cr content, as, particularly, AISI 409.

The present invention will be more clearly illustrated in the following detailed description of a preferred embodiment thereof, given as a non limiting example, with reference to the annexed figure.

The addition of the $Fe^{3+}$ ion as oxidant if performed according to the methods as per the embodiments (i) and (ii) is carried out by the introduction of the reagent into the bath in stechiometrically calculated amounts and considering the yields, both automatically and manually.

According to the invention, in the method of the embodiment (iii), an electro-chemical cell is employed.

According to this method an electro-chemical treatment of the solution is carried out, whereby it is directly obtained in situ formation and the control at the appropriate concentration levels of the oxidising species $Fe^{3+}$, originated by the $Fe^{2+}$ species anyhow contained within the bath.

The control of the $Fe^{3+}$ ions concentration within the pickling bath and/or of the $Fe^{3+}/Fe^{2+}$ ratio is obtained in an easy way by the setting and the regulations of the operative parameters of the cell.

Hereinafter, the principles and criteria for the construction of a $Fe^{3+}$ producing electro-chemical cell are defined.

a) Anolyte

The pickling solution itself is employed, continuously circulated (but a discontinuous treatment as well can be foreseen) from the bath by pumping;

b) Anodic Reaction

The anodic half-reaction which occurs in the cell is:

$$Fe^{2+} \rightarrow Fe^{3+} e. \quad (6)$$

Regulating the cell flow the reaction (6) kinetics is controlled, and it becomes therefore possible to keep steady at the desired level the concentration of the oxidising additive $Fe^{3+}$ in the pickling solution.

c) Catholyte

It was found that the most convenient way consists in utilising as catholyte a hydrochloric and/or sulphuric acid solution, that is sent to the bath according to the Fact that the specific pickling process foresees the in-bath utilisation of hydrochloric or sulphuric acid or mixtures thereof. In principle, however, any catholyte whatsoever may be utilised, or even directly the pickling solution, if the catholyte in this case is sorted out as exhausted.

d) Cathodic Reaction

The cathodic reaction, for ease of description referred only to the hydrochloric acid, is:

$$2H^+ + 2e \rightarrow H_2 \text{(cathodic half-reaction)} \quad (2)$$

e) Anodic Control

Regarding the control of the anodic current flow inside the electrolytic cell two alternatives are effective:

e.1) Potenziostatic Cell Control

Operating with an electrode potential(>771 mV SHE) that allows the oxidation reaction (6); regarding the maximum value it is advisable to choose a maximum value that does not allow (or anyhow limits to values that are not excessive) oxygen development, according to the following reaction:

$$O_2 + 4H^+ + 4e \rightarrow 2H_2O \ (E_{rev} = +1229 \text{ mv SHE}) \quad (7)$$

Theoretically, the preselected potential E finally lies within the range 771–1229 mV SHE. In practice it can prove useful to set it at values even relatively higher than 1229 mV (e.g. 1600), exploiting the fact that the oxygen development reaction occurs at a certain overvoltage and the kinetics involved may be negligible.

e.2) Galvanostatic Control

This control is simpler (more cost-effective) to realise in a plant, but the abovementioned advantages might be lost.

f) Membranes

Different commercial membranes may be used, that differ in efficiency, employ temperature, duration, dimension.

The electrochemical cell considered, tested in a pilot plant, gave the following performances, that are reported hereinafter, merely by way of exemplification:

current efficiency:>95%
cell potential (ΔV at terminals)≅2V
specific power≅b 5W/dm$^2$
anodic current density≅5A/dm$^2$
consumption per mole of $Fe^{3+}$ produced <0.1 kWh Subsequently, preliminary lab tests were carried out, demonstrating that higher than standard weight losses are obtained by employing $Fe^{3+}$ additioned solutions. Finally, experimental results were verified in industrial processes.

Further, the method of the invention is applicable for pickling products made of titanium and alloys thereof.

EXAMPLES

Hereinafter, examples of pickling of an hot-rolled AISI 409 steel carried out in lab and in industrial line and of two hot-rolled magnetic steels containing Si (the first magnetic steel being a Fe28 with an unoriented grain, 2.8% Si, 0.4% Al; the second being an oriented grain G32, 3.2% Si, 0.18% Cu).

Example with an AISI 409 Type Steel

The standard pickling solution for the AISI 409 steel is composed by:

free HCl=200 g/l
total Fe ($Fe_{tot}$=$Fe^{2+}$+$Fe^{3+}$) in solution up to 90 g/l.

It is essentially $Fe^{2+}$, but a certain amount of $Fe^{3+}$ up to about Sg/l is always present due to natural oxidation in air. T=75° C.

The industrial plant considered foresees four baths, each of approximately 15 m. The line speed for the AISI 409 utilised in the tests is 10 m/min and the resulting total pickling time is 360s.

The preliminary experimental tests were carried out performing two subsequent dippings into the solution, of 180s each, or by a single dipping of 360s.

Below Table 1 reports the obtained results.

TABLE 1

AISI 409 STEEL
T = 75° C.; HCl = 200 g/l
SCE = Standard Calomel Electrode

| 1° DIPPING | | | | 2° DIP. | | | |
|---|---|---|---|---|---|---|---|
| $Fe^{2+}$ g/l | $Fe^{3+}$ g/l | E mV (SCE) | $t_1$ (s) | $Fe^{2+}$ g/l | $Fe^{3+}$ g/l | $t_{tot}$ (s) | ΔPtot (g/m$^2$) |
| 90 | 0 | −430 | 180 | 10 | 0 | 360 | 78 |
| 90 | 0 | −430 | 180 | 0 | 10 | 360 | 93 |
| 68 | 22 | −415 | 180 | 0 | 20 | 360 | 103 |
| 12 | 82 | −350 | 360 | — | — | — | 288 |
| 43 | 48 | −360 | 360 | — | — | — | 231 |

The increases in the pickling kinetics (measured by the total weight loss APtot values) are self evident when the additive $Fe^{3+}$ is present.

Equally, as evidence of the illustrated mechanisms relative to the effect of the ferric ion on the steel working potential and, therefore, on the reaction kinetics, the table shows how in presence of $Fe^{3+}$ an increase of the electrode potentials (expressed in relation to the standard Calomel Electrode=SCE) occurs.

The possibility of increasing the rates, according to the experimental data, was then verified in line.

Then, a hot-rolled unpeened coil was utilised in a first trial with a specific speed of 10 m/min with the abovedescribed standard solution to produce a reference coil.

The reference solution was then enriched with $Fe^{3+}$ until the $Fe^{3+}$≧30 g/l value was obtained. The amount of $Fe^{3+}$ to be produced per bath tank is obtained by the following expression:

$$60\ g/l \times 25000\ 1 = 750\ kg$$

where 25000 1 is the volume of a bath tank.

In subsequent test trials, three different methods were adopted as described hereinafter:

a) Addition of hydrogen peroxide in the amount stechiometrically needed to obtain $Fe^{3+}$ in solution 60 g/l, considering a total yield of approximately 80%.
b) Additions of $FeCl_3$ for a $Fe^{3+}$ amount equal to 750 kg $Fe^{3+}$ per bath tank.
c) Adoption of an electrochemical cell of the membrane type as follows:

Surface: 5 m$^2$ of surface $(V)_{cell}$=2.5V

Current (I) 2.5 kA, supplied as long as needed to obtain the desired $Fe^3$ concentration of 30 g/l. The amount of electrical charge Q needed to produce the desired $Fe^{3+}$ amount (i.e. 750 kg) from $Fe^{2+}$ is easily calculated with the Faraday constant (i.e., 96500 Coulomb per mole of $Fe^{3+}$ produced).

Then, it is obtained:

$$Q = 96500 \times 750 \times 10^3/56 = 1.3 \times 10^9 \text{ Coulombs.}$$

Then, the temperature was adjusted at 75° C. and the trial was carried out with the line speed increased by 20% (from 10 to 12 m/min) . The coil obtained at the end of the trial is perfectly pickled according to the specifications. This result is perfectly reproducible with no variations and independent from the method utilised to add within the bath the desired amount of $Fe^{3+}$.

2$^{nd}$ Example with Magnetic Steels

With reference to the case of the magnetic steel the procedure was completely analogous to the abovementioned one for the AISI 409 steel example.

Two different steels were employed, both for the lab and in line trial tests:

Fe28 unoriented grain, 2.8% Si, 0.4% Al

G32 oriented grain, 3.2% Si, 0.18% Cu.

For the pickling of these magnetic steels a line was utilised having three baths, each of 15 m length.

For the test materials the results were as follows:

2.a) G32 Magnetic Steel

Line speed=36 m/min

HCl concentration variable from 120 to 200 g/l

Temperature=75° C.

Total pickling time=75 s.

2.b) Fe28 Magnetic Steel

Line speed=30 m/min

HCl concentration=120 g/l

Temperature=75° C.

Total pickling time=90s.

Preliminary lab tests were carried out with a single dipping for a time equal to the total (standard) pickling time. The data so obtained are reported in Tables 2 and 3, showing that additioned solutions with $Fe^{3+}$ (by addition of ferric chloride) and pickling times being equal, higher weight losses were obtained.

TABLE 2

G32 MAGNETIC STEEL
T = 75° C.
SCE = Standard Calomel Electrode
(*) Undetected potential

| HCl (g/l) | $Fe^{2+}$ (g/l) | $Fe^{3+}$ (g/l) | E mV (SCE) | $t_1$ (s) | $\Delta W_{tot}$ ($g/m^2$) |
|---|---|---|---|---|---|
| 200 | 50 | 0 | (*) | 70 | 58 |
| 200 | 0 | 50 | (*) | 70 | 133 |
| 120 | 60 | 0 | −415 | 90 | 57.54 |
| 120 | 30 | 30 | −390 | 90 | 66.28 |
| 120 | 0 | 60 | −375 | 90 | 75.92 |

TABLE 3

Fe28 MAGNETIC STEEL
T = 75° C.
SCE = Standard Calomel Electrode
(*) Undetected potential

| HCl (g/l) | $Fe^{2+}$ (g/l) | $Fe^{3+}$ (g/l) | E mV (SCE) | $t_1$ (s) | $\Delta W_{tot}$ ($g/m^2$) |
|---|---|---|---|---|---|
| 120 | 25 | 0 | (*) | 90 | 22 |
| 120 | 25 | 5 | (*) | 90 | 24 |
| 120 | 25 | 25 | (*) | 90 | 36 |

For the testing on the in line production, and with reference to a G32 coil having a thickness of 2.8 mm, a line speed of 36 m/min was utilised with the standard solution to produce a reference coil.

The reference solution was then enriched with $Fe^{3+}$ until obtaining a concentration ≧45 g/l as an optimal value, by means of the described above two different methods for the AISI 409 steel example.

Then, the temperature was adjusted at 75° C. and the pickling started with a 20% increase of the line speed (43 m/min). Therefore, a coil perfectly pickled was obtained according to the specifications.

Completely analogous results were obtained with the Fe28 steel, thus increasing of 20% the line speed (from 30 to 36 m/min).

The present invention is not limited to the embodiment examples, but includes any variation in the embodiments comprised within the scope of the following claims.

What is claimed is:

1. A method for pickling a steel product comprising contacting the steel product with a pickling bath, wherein in the pickling bath, composed of an aqueous solution of hydrochloric and/or sulphuric acid together with phosphoric acid, $Fe^{3+}$ is present in a concentration in the range 6–60 g/1, directly added or produced in the pickling bath itself by addition of an oxidizing agent selected from the group consisting of hydrogen peroxide, ozone, permanganates, persulphates, and oxygen.

2. The method according to claim 1, wherein the presence of the oxidant ion $Fe^{3+}$ within the pickling bath is obtained by one of the following steps:

direct addition of $Fe^{3+}$ as reactant deriving from ferric chloride or sulphate;

addition of oxidants apt to produce $Fe^{3+}$ by oxidation of the $Fe^{2+}$ ion present within the bath; and oxidation of ion $Fe^{2+}$ to $Fe^{3+}$ in an electrolytic cell containing an anolyte and a catholyte.

3. The method according to claim 2, wherein the catholyte is constituted by an aqueous solution of both hydrochloric acid and sulphuric acid.

4. The method according to claim 2, wherein the catholyte is introduced continuously into said pickling solution.

5. The method according to claim 2, wherein said electrochemical cell contains a membrane, and wherein the operation is carried out by controlling the anodic electrode potential or galvanostatically.

6. The method according to claim 2, wherein the working electrochemical potential (Ew) of said anode is >771 mV SHE.

7. The method according to claim 2, wherein the pickling solution is an aqueous solution of hydrochloric and/or sulphuric acid together with phosphoric acid, having a composition hereinafter:

free HCl from 0 to 250 g/l free $H_2SO_4$ from 0 to 250 g/l free $H_3PO_4$<100 g/1

$Fe_{tot}$ as $(Fe^{2+}+Fe^{3+})$≧50 g/l $Fe^{3+}$ (additive) from 5 to 60 g/l $Fe^{3+}/Fe^{2+}$≧0.1.

8. The method according to claim 7, wherein said pickling solution is at a temperature within the range of 40–90° C.

9. The method according to claim 8, wherein the catholyte is constituted by an aqueous solution of hydrochloric acid and sulphuric acid.

10. The method according to claim 9, wherein the catholyte is introduced continuously into said pickling solution.

11. The method according to claim 10, wherein said electrochemical cell comprises a membrane, and wherein the operation is carried out by controlling the anodic electrode potential or galvanostatically.

12. The method according to claim 11 wherein the working electrochemical potential (Ew) of said anode is ≧771 mV SHE.

13. The method according to claim 1, wherein the pickling solution is an aqueous solution of hydrochloric and/or sulphuric acid together with phosphoric acid, having a composition hereinafter:

free HCl from 0 to 250 g/l free $H_2SO_4$ from 0 to 250 g/l free $H_3PO_4 \leqq 100$ g/l $Fe_{tot}$ as $(Fe^{2+}Fe^{3+}) \geqq 50$ g/l $Fe^{3+}$ (additive) from 5 to 60 g/l $Fe^{3+}/Fe^{2+} \geqq 0.1$.

14. The method according to claim 13, wherein said pickling solution is at a temperature within the range of 40–90 ° C.

15. The method according to claim 14, wherein oxygen is fed in an external reactor with respect to the pickling bath; said reactor being set at a temperature lower and/or at a pressure higher or equal to the pickling bath.

16. The method according to claim 1 wherein oxygen is fed in an external reactor with respect to the pickling bath; said reactor being set at a temperature lower and/or at a pressure higher or equal to the pickling bath.

17. The method according to claim 1, wherein the steel products to be pickled are selected from the group consisting of:

carbon steels;

magnetic steels; and stainless steels with a low Cr content.

18. The method according to claim 17 wherein said steel products to be pickled are carbon steels selected from the group consisting of hot or cold worked low carbon steels and carbon steels with a low, medium or high content of alloying elements.

19. The method according to claim 17 wherein the steel products to be pickled are selected from the group consisting of magnetic steels containing Si or Si and Al, and stainless steels containing less than 15% Cr.

* * * * *